United States Patent [19]

Yaworsky

[11] 4,232,864

[45] Nov. 11, 1980

[54] GAME APPARATUS WITH MOVABLE SUPERIMPOSED BOARDS AND VIEWING STRUCTURE

[76] Inventor: James J. Yaworsky, 133 Richmond St. West, Toronto, Ontario, Canada, M5H 2LR

[21] Appl. No.: 358

[22] Filed: Jan. 2, 1979

[51] Int. Cl.[3] ..... A63F 3/00; A63F 9/00

[52] U.S. Cl. ..... 273/241; 273/287; 273/284; 273/282; 273/265

[58] Field of Search ..... 273/241, 284, 283, 287, 273/271, 273, 265

[56] References Cited

U.S. PATENT DOCUMENTS

| | | | |
|---|---|---|---|
| 3,127,174 | 3/1964 | Ryan | 273/265 X |
| 3,464,701 | 9/1969 | Mahoney | 273/241 |
| 3,481,603 | 12/1969 | Sugden | 273/271 |
| 3,508,753 | 4/1970 | Mackey | 273/241 X |

FOREIGN PATENT DOCUMENTS

| | | | |
|---|---|---|---|
| 1487327 | 5/1967 | France | 273/265 |
| 1160120 | 7/1969 | United Kingdom | 273/241 |

*Primary Examiner*—Richard C. Pinkham

*Assistant Examiner*—Scott L. Brown

[57] ABSTRACT

The specification discloses a game apparatus having at least two identical playing surfaces and playing pieces adapted to releasably engage the playing surfaces. The apparatus also includes means to superimpose the playing surfaces wherein at least one of said playing surfaces is movable from the superimposed position. The playing surfaces and playing pieces are at least partially transparent providing observation of nonoverlapping playing pieces and at least recognition of overlapping playing pieces when the playing surfaces are superimposed. The game structure allows for simultaneous movement of the playing pieces by all players and increases the possibility of confrontation with a number of players. The game apparatus is designed to allow realistic observation from above superimposed playing surfaces, or in some instances, side viewing along the plane of these surfaces. The game apparatus allows for infinite variation of the board surface. The unique game board structure is easily adapted for a number of existing games as well as new games and thus provides a very versatile game apparatus.

7 Claims, 7 Drawing Figures

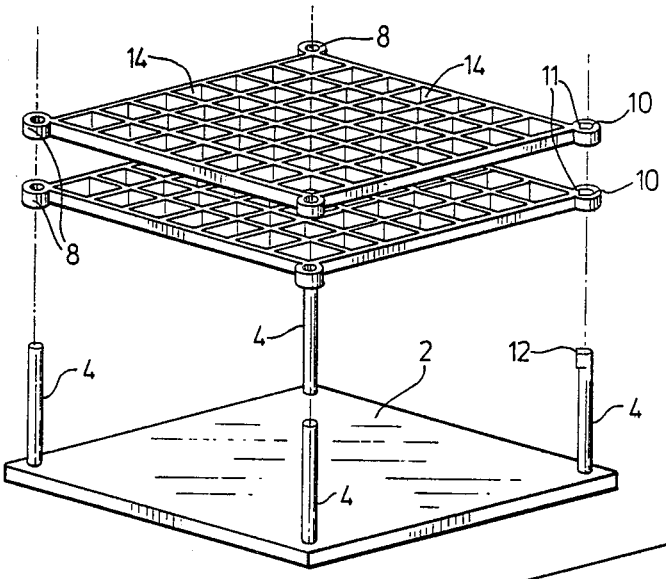
FIG.1.
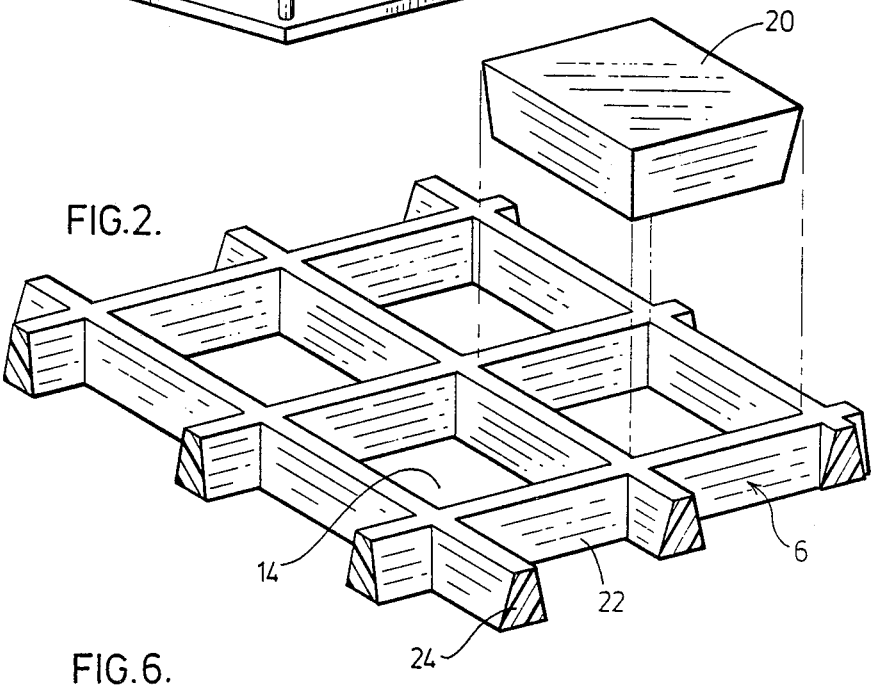
FIG.2.
FIG.6.
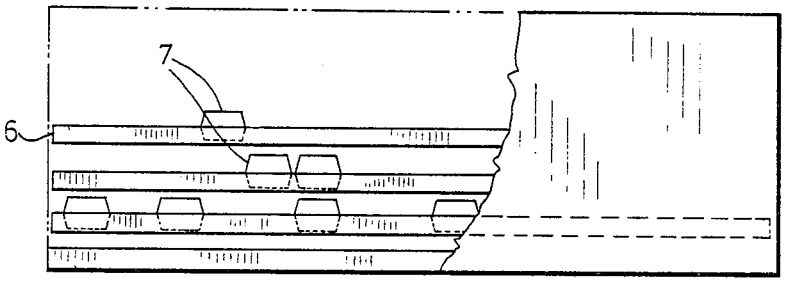

FIG.5.
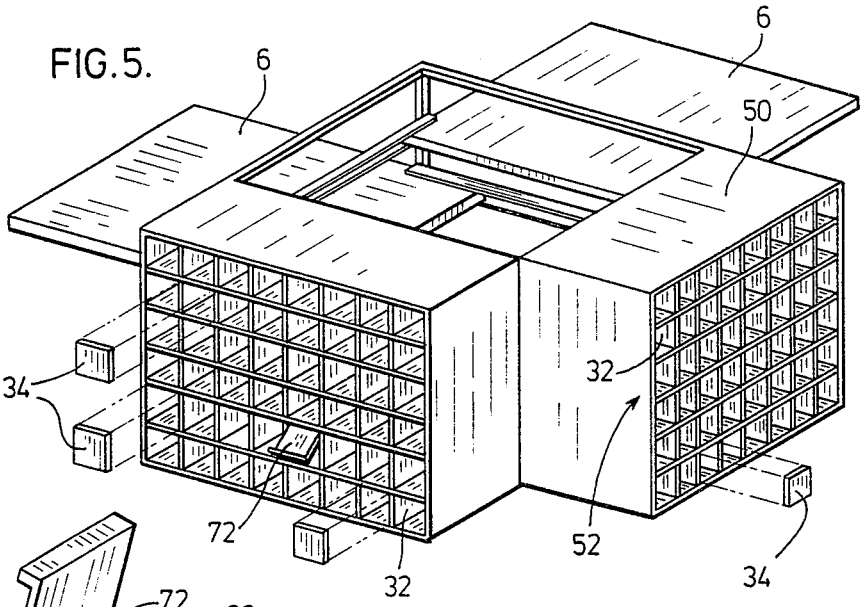
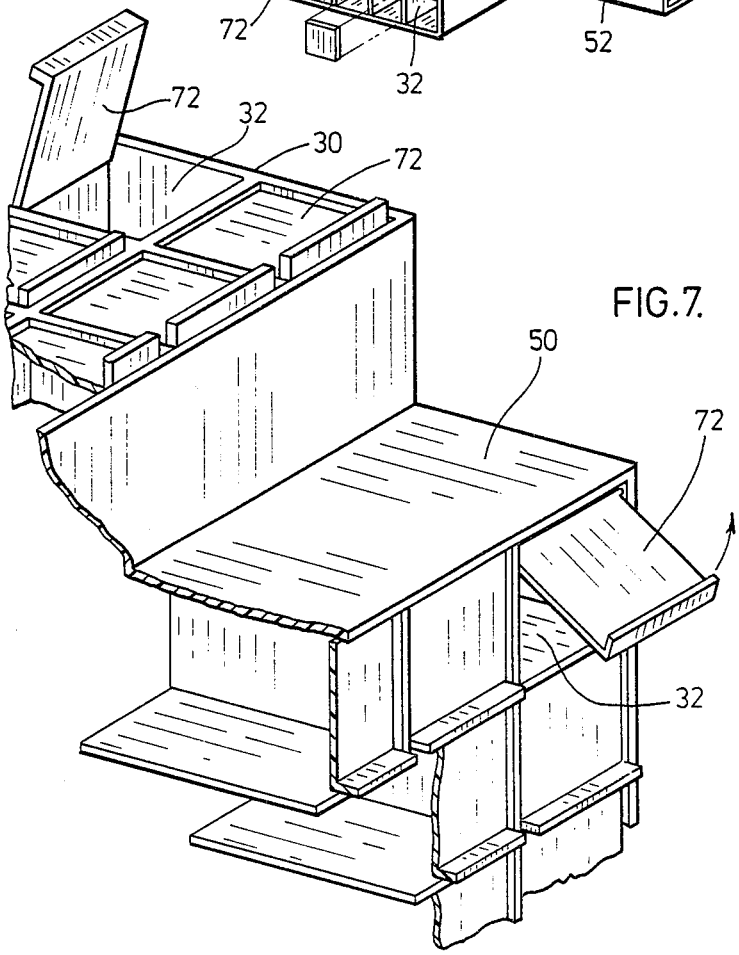
FIG.7.

GAME APPARATUS WITH MOVABLE SUPERIMPOSED BOARDS AND VIEWING STRUCTURE

FIELD OF THE INVENTION

The present invention relates to a game apparatus which allows simultaneous movement of playing pieces by all players and includes means to discriminate the viewing area of superimposed playing surfaces. The game apparatus also provides horizontal and/or vertical viewing of playing pieces.

BACKGROUND OF THE INVENTION

In current flat board games, each player takes a turn moving and the outcome of such a move is readily apparent as no other player is involved. The flat game board also provides each player with accurate and total observation of the game conditions. Both of these inherent principles of current games are believed to limit the intrigue of such games as the move decision process has been greatly simplified. In real life, information must be gathered from a number of sources and the accuracy of the information evaluated prior to making a decision. However, the current flat board games eliminate this evaluation of all available information as total accurate information is readily visible to the player.

The designing of a game apparatus which allows this uncertainty of information to be included, results in an intriguing game which has high degree of appeal to older players. However, the game structure not only allows a high degree of uncertainty, it also allows this level of uncertainty to be varied, such that a player just learning the game need not play the most complicated version.

SUMMARY OF THE INVENTION

The game apparatus of the present invention comprises at least two essentially identical playing surfaces, playing pieces adapted to releasably engage said playing surfaces and means to superimpose the playing surfaces. At least one of the playing surfaces is moveable from the superimposed position and the playing pieces and the playing surfaces are at least partially transparent providing observation of non-overlapping playing pieces and at least recognition of overlapping playing pieces when the playing surfaces are superimposed.

In a preferred aspect of the invention, the game apparatus is provided with a viewing means which can be adapted such that the entire surface of superimposed playing surfaces is not visible.

In a further preferred aspect, the game apparatus is provided with a base playing board, which terrain factors can be varied as desired.

The unique game apparatus provides an apparatus where all players effectively move simultaneously and observation of the playing pieces may be restricted.

BRIEF DESCRIPTION OF THE DRAWINGS

Preferred embodiments of the invention are shown in the drawings, wherein:

FIG. 1 is a perspective view of the basic game apparatus in which two playing surfaces are shown;

FIG. 2 is an enlarged partial section of a playing surface illustrating how playing pieces nest in the playing surface;

FIG. 5 is a perspective view of the game apparatus adapted for horizontal viewing of the playing surfaces;

FIG. 6 is a side view of superimposed playing pieces with nested playing pieces adapted for horizontal viewing of the playing surfaces; and FIG. 7 is a perspective view of part of the viewing means, wherein it has been provided with a number of flaps for restricting the observable areas of playing surfaces.

DETAILED DESCRIPTION ACCORDING TO THE PREFERRED EMBODIMENTS OF THE INVENTION

Figure 3:
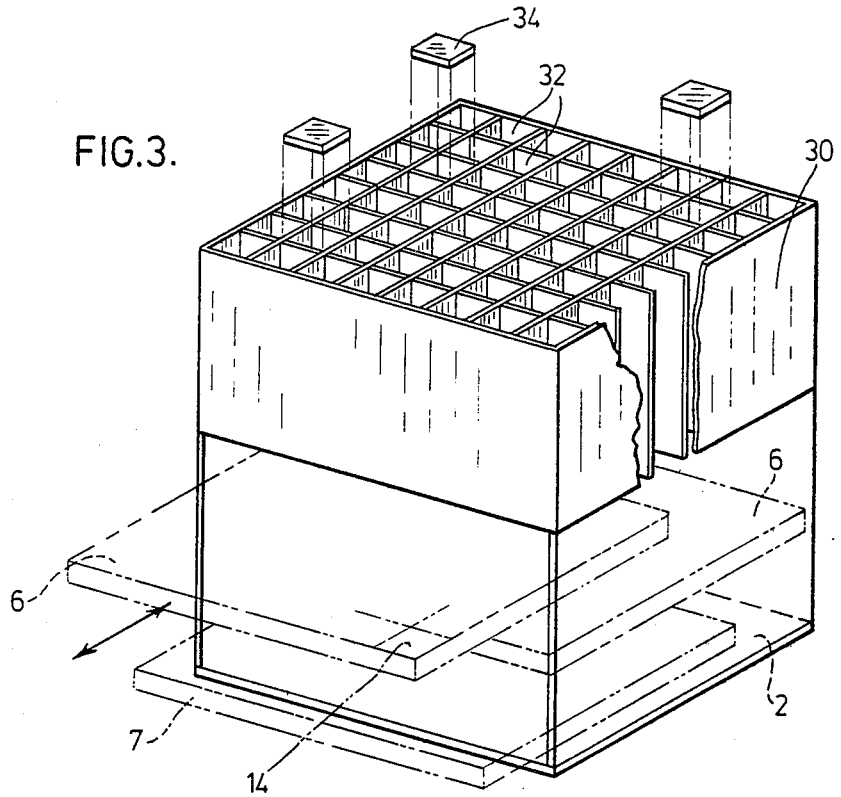
FIG. 3 is a perspective view of the game apparatus including a variable viewing means and wherein the game apparatus has been adapted to slideably receive the playing surfaces.

The game apparatus as shown in FIG. 1, comprises a base portion 2, aligning posts 4, and playing surfaces 6. The corners of the playing surfaces have been provided with centering eyes 8 and one eye has been adapted with a rectangular cut out portion 11 such that the orientation of the playing surface, relative to the base portion, remains constant. This cut out portion aligns with the aligning post 4 which has been provided with the rectangular key 12. As can be appreciated, the players remove the playing surfaces 6 from the apparatus and then arrange their playing pieces into the appropriate apertures 14, provided in the playing surface. After these pieces have been arranged, the playing surfaces are placed in the game apparatus and the players can then compare the locations of playing pieces by viewing the playing boards from above. This particular structure would be very useful with a game such as chess, where each player can move simultaneously and thus create a completely new dimension to the game. It can readily be appreciated that because the playing pieces are being observed from above and through the upper playing board, the playing pieces would be at least semitransparent and the apertures 14 align with similar apertures in the lower board. The overlap of playing pieces when the playing surfaces are superimposed will be apparent as they will appear darker due to the reduction in the amount of light transmitted. If a number of playing pieces overlap it may be necessary to remove the playing surfaces to determine what pieces are involved; however, it will easily be recognized when playing surfaces are superimposed that an overlap of playing pieces has occurred. To assist in recognition of overlapping playing pieces, the base portion 2 may be white in colour.

FIG. 2 is a partial section of a playing surface 6 illustrating how the playing surface is made up of a grid-type network of longitudinal members 22 and horizontal members 24. As can be seen, the apertures 14 are larger in area at the upper surface and taper somewhat inwardly to a reduced area at the lower edge of the playing surface. This is readily apparent from the frusto conical section of the grid members 22 and 24. The playing piece 20 is shaped in a similar manner to the grid system and therefore, nests within the playing surface and does not extend substantially above the playing surface 6. If the playing piece 20 was to be used as a chess piece for example, an appropriate shape could be etched into the upper surface of the playing piece enabling the players to distinguish various playing pieces.

The grid-type network of the playing surfaces 6 and the playing pieces 20 are of rectangular cross section. However, other shapes of networks such as a honeycombed network could be used and the playing pieces modified accordingly.

The embodiment shown in FIG. 3, illustrates how the playing surfaces 6 may be superimposed by sliding the surfaces in from any side of the game apparatus. It is clear from this Figure that the game apparatus could easily be used with a number of playing surfaces and need not be limited to only two. The game apparatus has also been adapted with a top viewing means 30 provided above the base portion 2. This viewing means has a number of rectangular open tube-like members 32 which are directly above respective apertures 14 of superimposed playing surfaces. The viewing means limits the amount of peripheral vision of each player when looking through the viewing means and is adapted with a number of cap members 34 such that certain areas of the playing surfaces would not be visible. The cap members 34 are removeable and are sized to cover one of tube members 32. In the lower portion of FIG. 3, a base terrain board 7 has been provided which can be adapted for different games. Often the terrain board 7 is prepared at the beginning of the game and remains constant throughout the game. For example, in the game of chess, a black and red checker board outline could be secured to the board 7. In a war game, the terrain board 7 could be adapted with various peices to represent geographical factors, such as hills, rivers, forests, and fields, for example. It is apparent that the terrain could be varied as desired by the players and need not be the same for each game nor constant for each time a game is played. Again as in FIG. 1, each player would withdraw his playing surface from the game apparatus and arrange the playing pieces as he wishes. After all players have completed their move, the playing surfaces are inserted into the game apparatus superimposing the playing surfaces beneath the viewing means 30. At least a portion of the resulting playing surface is then observed through the viewing means, which has been provided with caps 34. These cap members must be removed to observe the portion of the superimposed playing surfaces beneath such caps.

Figure 4:
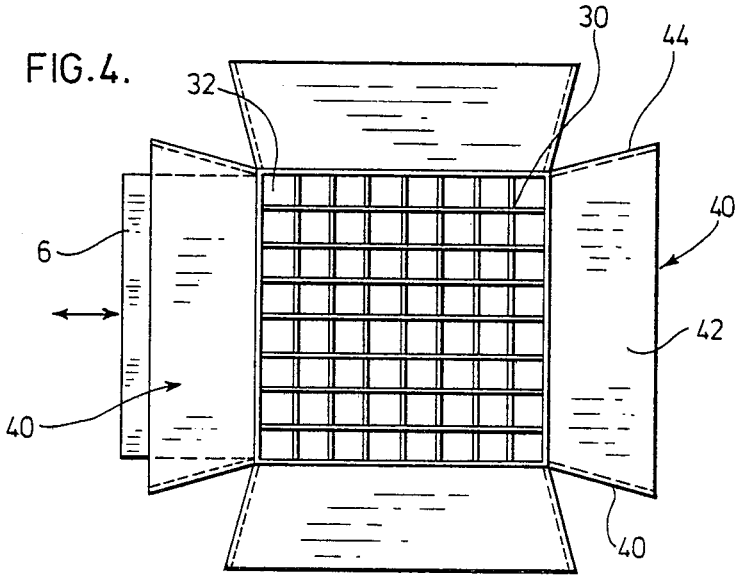
FIG. 4 shows a top view of the game apparatus provided with a variable viewing means and side and top screening partitions for shielding each player's playing surface from observation by other players when the playing surfaces are partially withdrawn from the structure.

The embodiments shown in FIG. 4 includes playing surface screening partitions 40 having a top screening partition 42 and slide screening partitions 44, which allow each player to withdraw a playing surface from the game structure and arrange the playing pieces on this surface without having this surface observed by other players. The game structure as shown in this Figure would best be suited for four players, each having their own side of the playing structure. However, additional players could also be included by using additional playing surfaces and having players use the same screening partitions, one at a time. As can be seen in the Figure, the playing surfaces 6 can be withdrawn from the game apparatus and supported within the screening portion 40. It is apparent that the game apparatus could be adapted with reference boards positioned to each side of the playing structure such that each player may mark the position of terrain or other pieces he has observed during his turn. The reference boards could be positioned to align beneath a playing surface which has been withdrawn from the game apparatus making it easier for the player to plan his next move. To assist the player in rearranging his pieces, the top screening partition 42 slopes upwardly and outwardly from the game apparatus. Again after all the playing surfaces have been aligned within the game structure, players can view the resulting position of playing pieces through the top viewing means 30. As the number of players increases, the number of playing surfaces 6 also increases and the visibility of playing pieces in the lower playing surface may be impaired. To overcome this problem, a light may be inserted beneath the game structure and the base portion made transparent, thereby increasing the amount of light transmitted through the game boards. The visibility of the playing pieces can be further increased by providing mirror like surfaces to the viewing tubes 32 and/or the vertical surfaces of the grid members 22 and 24. As one can readily appreciate, observation through the top viewing means allows the players to interpret the exact location of playing pieces.

The game apparatus as shown in FIG. 5 has been adapted with two side viewing means 50 which are positioned at adjacent sides of the game apparatus and allow players to view along the plane of the playing surfaces. FIG. 6 illustrates a typical view of the playing surfaces as seen through one of these side viewing means 50. As with the top viewing means, the side viewing means have been provided with a grid type network and have number of viewing tubes 32 through which the player observes a portion of the playing surfaces. These viewing tubes 32 may be adapted with cap members 34 or flap members 72, which allow a portion of the viewing means to be closed such that the player can not observe the entire plane of the playing surface. The particular side viewing means shown have been provided with 6 horizontal viewing planes 52 and therefore as many as 6 playing surfaces may be inserted in the game apparatus. Although in some games as many as 6 different players may use the game apparatus, it is also possible to device games where a lesser number of players can use the structure and each player has a number of different playing surfaces. For example, in some games it may be valuable for each player to have three playing surfaces which may represent the surface level of an ocean, the air above the ocean, and water below the ocean level, such that the player can control various pieces which could represent destroyers, airplanes, and submarines for example. In this particular example, the side viewing means as shown, could have the top two levels representing the air, the next two levels representing the level of the water and the last two levels being below the water level and the apparatus could be used by two players. In a game such as this the player would only be allowed to look along the particular air, water level or below water level as permitted by the rules of the game. For this reason the side viewing means are provided with either cap members 34 or flap members 72. In some games, the playing surfaces 6 may be very large and therefore the extent to which the side viewing means restrict the viewing area of playing board 6 may be limited, as the observable area at the opposite side of the playing surface may be more visible than the portion of the playing surface immediately in front of the viewing means 50. In this case, the rules of the game may allow a player to position the side viewing means 50 at the opposite side of the game apparatus such that he can observe the opposite edge of the playing surface with the same advantage. Although the apparatus has been shown with two side viewing means 50, only one viewing means need be supplied if it is movable about the game apparatus. However, it is anticipated that two viewing means will normally be used.

As can be seen in FIG. 6, which is a typical view through one of the side viewing means, the playing pieces 7 have been adapted to project slightly above the playing surfaces 6 such that they are visible. It can be appreciated that various shapes and adaptions to the playing piece 7 can be made to enhance the ease of observation of such pieces. Furthermore, the game apparatus could be adapted such that the playing surfaces 6 slide into a side of the game apparatus which does not have one of the side viewing means.

In some instances, the apparatus as shown in FIG. 5 will be provided with a top viewing means as in FIG. 3 such that players will be able to not only observe along the plane of the playing surfaces, but will also be able to observe the superimposed playing surfaces from above.

FIG. 7 shows one embodiment of the invention where both the side column viewer and the top column viewer have been adapted with hinged flap members 72 such that certain areas of the viewing means may be opened while other areas of the viewing means, remain closed. However, other methods could also be employed. FIG. 7 shows a portion of both side viewing means 50 and the top viewing means 30. Both viewing means are of a network structure and are fairly deep. The network structure of the viewing means is continuous over this depth dimension such that viewing tubes 32 provide a tunnel effect which reduces the observable peripheral area of the playing surface. A further reduction in the observable peripheral area with a top viewing means, may be accomplished by placing the superimposed playing surfaces as closely beneath the viewing means as possible. Also it is apparent the playing surfaces could be modified in a number of ways to limit the observable peripheral area. It is important the observable peripheral area is limited to assure the viewing means in conjunction with the cap 34 or flap member 72 effectively limit the observable area of superimposed playing surfaces.

As will be appreciated from the above, the present invention which allows simultaneous movement by all players, realistic observation of game conditions, as well as the capability of allowing a number of players to play provides a game with a unique and challenging nature.

Although various embodiments of the invention have been described herein in detail, it will be apparent to those skilled in the art that variations may be made thereto without departing from the spirit of the invention or the scope of the appended claims.

What I claim is:

1. A game apparatus comprising at least two corresponding playing surfaces, playing pieces adapted to releasably engage said playing surfaces, means to superimpose said playing surfaces, wherein at least one of said playing surfaces is movable from the superimposed position and wherein said playing pieces and said playing surfaces are at least partially transparent providing observation of non-overlapping playing pieces when said playing surfaces are superimposed, the apparatus further including a viewing means having a planar network structure defining open apertures and means to cover such apertures, said viewing means located above superimposed playing surfaces to provide at least partial viewing of superimposed playing surfaces and playing pieces.

2. A game apparatus as claimed in claim 1, wherein said means to superimpose said playing surfaces includes a base portion designed to slidably receive said playing surfaces.

3. A game apparatus as claimed in claim 1, wherein said playing surfaces and said viewing means each comprise a similar planar network structure which vertically align when said playing surfaces are superimposed.

4. A game apparatus as claimed in claim 1, 2 or 3, wherein said playing peices are sized to at least partially nest within said playing surfaces.

5. A game apparatus comprising a least two corresponding horizontal playing surfaces movable from a superimposed position; playing pieces adapted to releasably engage said playing surfaces and extend above thereof; means to superimpose said playing surfaces, and at least one side viewing means with each viewing means located to a side of superimposed playing surfaces; said viewing means comprising a network structure defining open tubes defining apertures through which playing pieces mounted on said playing surfaces can be observed and further including means to selectively cover portions of said viewing means to provide partial viewing along superimposed playing surfaces.

6. A game apparatus as claimed in claim 1 or 5 wherein said means to selectively cover portions of said viewing means includes cap portions sized to engage a single open aperture of said network structure.

7. A game apparatus as claimed in claim 1 or 5 wherein said means to selectively cover portions of said viewing means include flap portions hinged to said network structure and sized to cover a single open aperture of said network structure.

* * * * *